United States Patent [19]

Bauer et al.

[11] 3,943,695

[45] Mar. 16, 1976

[54] QUARTZ CRYSTAL CONTROLLED TIMEKEEPING APPARATUS

[75] Inventors: Manfred Bauer; Herbert Kroesche; Roland Sauter; Helmut Stechmann, all of Schwenningen, Germany

[73] Assignee: Kienzle Uhrenfabriken GmbH, Schwennigen, Germany

[22] Filed: Feb. 15, 1974

[21] Appl. No.: 442,940

[30] Foreign Application Priority Data

Feb. 19, 1973 Germany ..... 2308057
Feb. 19, 1973 Germany ..... 2308058

[52] U.S. Cl. ..... 58/23 D; 58/140 A
[51] Int. Cl.[2] ..... G04C 3/00; G04B 13/02
[58] Field of Search ..... 58/23 R, 23 D, 53, 55, 58/140 A

[56] References Cited

UNITED STATES PATENTS 3,792,577 2/1974 Fujita ..... 58/23 R
3,800,523 4/1974 Yamazaki ..... 58/23 R

*Primary Examiner*—Edith Simmons Jackmon
*Attorney, Agent, or Firm*—Pollock, Philpitt & Vande Sande

[57] ABSTRACT

This invention relates to electric clocks and chart recorders driven by crystal controlled electric motors. The motor includes two stator plates, a rotor and a drive coil surrounding the legs of the stator plates. The rotor carries a pinion which drives the first gear of a mechanical gear train located between two side plates consisting of synthetic resin material. One of the side plates carries at least one bearing for the rotor and a plurality of projections which fit into holes in the stator plates and serve to position the stator plates in relation to the rotor. Electric pulses are supplied to the drive coil by an electronic frequency divider circuit having a push-pull output stage; a zener diode is connected in parallel with the power supply to the divider circuit and the drive coil to enable the motor to operate satisfactorily over a range of supply voltages. For this purpose, the drive coil preferably has a resistance of more than 1K and a resistor is connected in series between the supply and the zener diode.

19 Claims, 9 Drawing Figures

QUARTZ CRYSTAL CONTROLLED TIMEKEEPING APPARATUS

The present invention relates to time-keeping apparatus. Time-keeping apparatus is known in which the output of a crystal oscillator is fed to an electronic frequency-divider circuit controlling a motor which drives a mechanical gear train assembled between two side plates. In the known units of this kind, the motor is normally designed as a separate component. This motor, consisting of a stator and a rotor, is mounted by means of a flange joint on one of the side plates. The outlay involved in assembling these components is considerable. Moreover, the motors involved operate at relatively high speeds so that bearing problems arise and relatively long gear trains are needed.

Consequently, the need arises to integrate the motor with the side plates which accommodate the gearing, and a further need is to so arrange the components that the tolerances between stator and rotor are as small as possible, the engagement between the rotor pinion and the first gear in the gear train, being correct at all times and requiring no adjustment.

The invention relates to crystal-controlled time-keeping apparatus including a crystal oscillator, the output of which is fed to an electronic frequency-divider circuit controlling a motor which has a drive with a rotor and a plurality of stator plates and drives a mechanical gear train located between two side plates made of synthetic resin material, wherein one of the said side plates carries at least one bearing for said motor and a plurality of projections which fit into holes in the said stator plates.

Preferably, an auxiliary yoke of magnetically soft sheet metal is arranged on said one side plate, spaced from the stator plates. The pole position of this yoke is staggered in relation to that of the stator plates. The arrangement may be such that the stator plates are located on one side, and the auxiliary yoke on the other side of the side plate. Preferably, the rotor is arranged so that the rotor passes through the plane of the side plate.

The other rotor bearing may be arranged on the other side plate, this bearing having the rotor drive pinion disposed adjacent to it.

There is frequently the requirement that time-keeping apparatus should be capable of operation throughout a wide range of supply voltages. Variations in supply voltage may be due, for example, to variations in battery voltage during the life of a battery, or may be due to differences in the design of the control circuits. In apparatus available heretofore, these requirements have not always been satisfactorily met. In particular, drawbacks arise from the fact that the resistance of the drive coil is relatively low and that the coil and the control circuit are connected directly to the battery voltage. A further possible requirement is that the output stage of the frequency divider circuit should be capable of driving bipolar or unipolar motors. A bipolar motor is one which has to be supplied with current impulses of alternating directions.

These additional requirements can be met in apparatus in accordance with the invention by providing the frequency-divider circuit with a push-pull output stage and by connecting a zener diode in parallel with the power supply to the divider circuit and the drive coil.

The drive coil preferably has a resistance of more than 1 k.

The invention will be explained in more detail hereinafter, making reference to examples:

Figure 1:
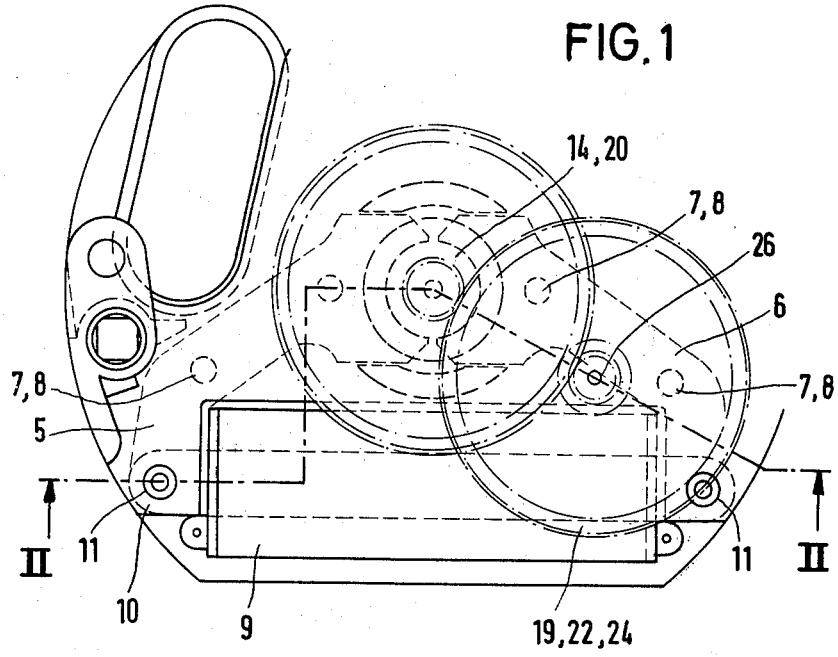
FIG. 1 is a plan view of a first embodiment.
Figure 2:
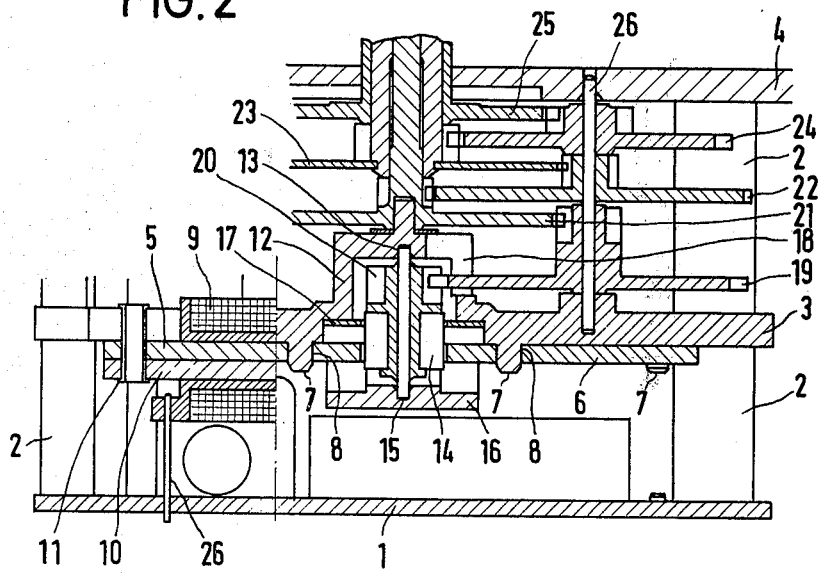
FIG. 2 is a section along the line II—II of FIG. 1.

The electric clock illustrated in FIGS. 1 and 2 includes a printed circuit board 1 (FIG. 1) carrying the electrical components. This board is attached by pillars 2 to a first side plate 3 of synthetic resin material. This latter is in turn attached by pillars 2 to a second side plate 4.

The side plate 3 carries two stator plates 5 and 6. A plurality of projections 7 are formed on the side plate 3 and these projections engage in corresponding holes 8 in the stator plates 5, 6 which are both formed of a non-magnetic material. In this fashion, precise spatial positioning of these stator plates in relation to one another is ensured. The two stator plates are flat in design and are located in the same plane so that they do not contain any bends. Such bends are normally present and this leads to an unnecessary increase in tolerances.

The two stator plates 5, 6 include legs which abut one another and a core 10 located inside a coil 9 overlaps these legs. The arrangement is preferably such that at least one of the legs of the stator plates 5, 6 is located, together with the core 10, inside the coil 9. Where the core 10 overlaps the leg of the stator plate 5 outside the coil, fastener means 11, preferably in the form of a hollow rivet, is provided in order to link the stator plate 5 and the core 10, to the side plate 3. A similar fastener is provided where the core 10 overlaps the leg of the stator plate 6.

The side plate 3 furthermore has a cup-shaped recess 12 which contains a bearing 13 for the rotor 14. The other rotor bearing 15 is located on a bridge 16 attached to the side plate 3.

An auxiliary yoke 17 is arranged inside the recess 12, spaced from the stator plates 5, 6. This auxiliary yoke 17 has a slightly different pole position from the stator plates 5, 6, thereby providing a staggering of the pole position of the auxiliary yoke relative to that of the stator plates 5 and 6, so that in operation the rotor 14 has a preferential direction of rotation. The motor is designed as a stepping motor.

One side of the recess is provided with a slot 18 through which a gear 19 meshes with a pinion 20 on the rotor 14. A further pinion fixed to the gear 19 meshes with a gear 21 whose pinion is in turn in mesh with an intermediate gear 22. Yet another pinion fixed to the intermediate gear 22 meshes with a gear 23 whose pinion is in turn in mesh with a further intermediate gear 24. The pinion of the intermediate gear 24 meshes with a gear 25. The gears 19, 22 and 24 are disposed coaxially in relation to one another and are mounted on a common shaft 26 between the side plates 3 and 4.

Correspondingly, the gears 21, 23 and 25 are coaxially arranged and assembled between the side plates 3 and 4.

The printed circuit board 1 carrying the electronic components is provided with two pins 26 projecting away from it, which pins extend into the neighbourhood of the two ends of the drive coil 9. They serve to connect the ends of the coil 9 to the control circuit. If required, the two pins may be fixed to the coil former, projecting into bores in the printed circuit board and being conductively connected thereto.

Figure 3:
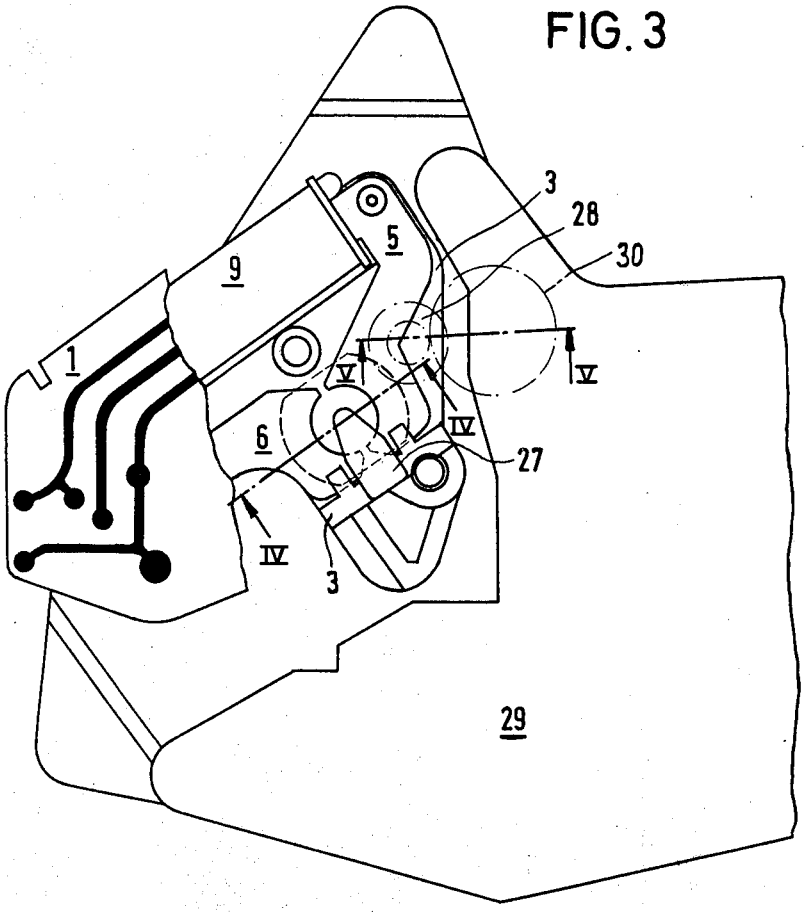
FIG. 3 is a plan view of a further embodiment.
Figure 4:
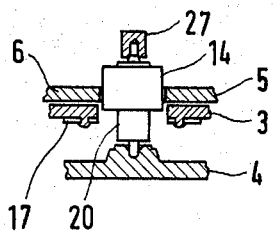
FIG. 4 is a section along the line IV—IV of FIG. 3.
Figure 5:
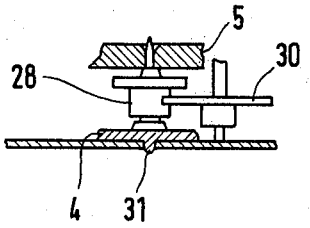
FIG. 5 illustrates a section along the line V—V of FIG. 3.

In the example of FIGS. 3, 4, and 5, the crystal-controlled unit is connected by a flange unit joint to a chart recorder 29. In this example, the side plate 3 has a block 27 formed integrally therewith on which a bearing for the rotor 14, 20 is arranged. As the section IV—IV of FIG. 4 shows, the other rotor bearing is arranged on the other side plate 4.

The permanent-magnetic part 14 of the rotor passes through the plane of the side plate 3. The auxiliary yoke 17 is arranged on the side of the plate 3 opposite to the stator plates 5, 6. This auxiliary yoke 17 contains holes into which projections on the side plate 3 penetrate. By warming up the ends of these projections the auxiliary yoke 17 can be secured in a simple fashion.

The pinion 20 of the rotor engages with an intermediate gear which in turn drives a further intermediate gear 28. The intermediate gear 28 has a pinion meshing with the first gear 30 of the recorder 29. In order to ensure proper alignment between the pinion of gear 28, and the gear 30, a pin 31 is provided on the outside of the side plate 4, said pin extending coaxially with the gear 28. This pin 31 engages in a hole in a side plate of the recorder 29. This is shown in FIG. 5.

The angle through which the rotor turns with each pulse through the drive coil, may be, for example, 180°, so that the rotor, the stator plates and the auxiliary yoke can be of simple design. The period of the pulses may be, for example, two seconds, during which period two current pulses of alternating direction and each lasting 0.5 seconds, occur.

Figure 6:
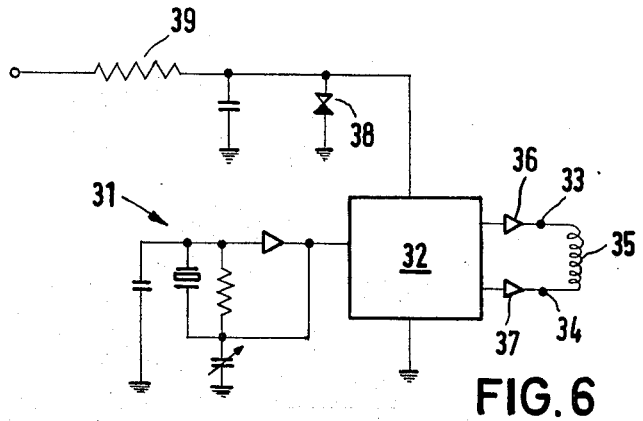
FIG. 6 illustrates a basic circuit diagram.

In FIG. 6, the reference 31 donates a known crystal-controlled oscillator circuit. This oscillator supplies a divider circuit 32 which has two outputs 33 and 34 operating in push-pull. To these outputs 33 and 34 the drive coil 35 is connected. The references 36 and 37 denote the two final amplifier stages or driver circuits, at the output of the divider circuit 32. In parallel with the power supply to the divider circuit 32 there is a zener diode 38. Through the chosen circuit arrangement, the drive coil 35 is also protected, along with the driver circuits 36, 37 by the zener diode 38. In the lead between the battery (not shown) and the zener diode, a resistor 39 is arranged. If, for example, a rated voltage of 12 volts is available, then the resistor 39 will have a resistance of 330 ohms. Taking a drive coil resistance of, for example, 1.7 k, it is readily possible to handle a voltage range of between 7 and 16 volts. If the rated voltage is 24 volts, it is simply necessary to employ resistor 39 having a resistance of 1.5 k. In this case, a voltage range of between 16 and 30 volts can be dealt with.

Figure 7:
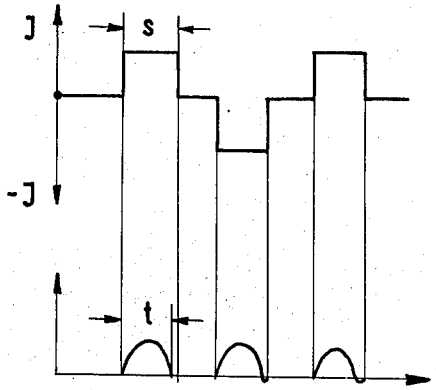
FIG. 7 illustrates the pulse form and rotor motion, obtained with the circuit arrangement of FIG. 1.

In association with these circuit details, in order to ensure reliable operation of the motor, the pulse duration $s$ (see FIG. 7) must be longer than the time $t$ required by the rotor in order to step from one position under the influence of the magnetic forces generated in the stator with the passage of a pulse, to the next position. This means that the rotor must be magnetically stopped at the end of its stepping motion so that it cannot overshoot. This would be liable to happen with an increased supply of energy and without the introduction of any measures to produce stabilising.

Figure 8:
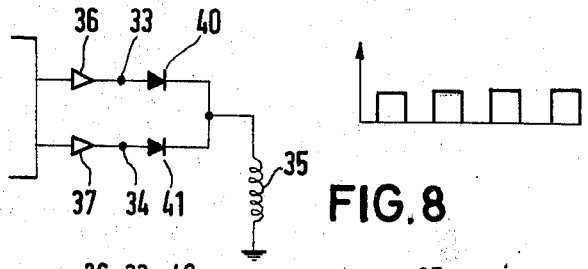
FIG. 8 illustrates a variant of the circuit and the associated pulse form.

To operate a unipolar motor, the circuit of FIG. 8 is used. At the outputs 33 and 34, two similarly directed diodes 40 and 41 are connected, the cathodes of these diodes being connected to one end of the drive coil 35. The other end of the drive coil 35 is earthed.

Figure 9:
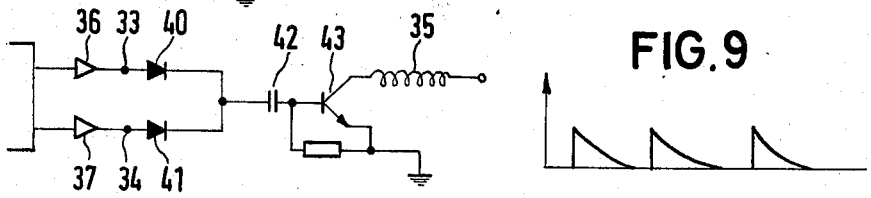
FIG. 9 illustrates a further variant of the circuit with an indication of the pulses which occur therein.

In a modified circuit, as shown in FIG. 9, the cathodes of the diodes 40 and 41 are connected through a capacitor 42 to the base electrode of a transistor 43. The drive coil 35 is arranged in the collector circuit of the transistor 43. The pulse form of FIG. 9 is determined by the discharge characteristics of the capacitor 42.

The rotor of the motor, with each current pulse, turns through an angle which may be, for example, as long as 180°. This virtually excludes stepping errors of the kind which can arise where the rotary increments are small.

The period of the pulses supplied to the drive coil may be, for example, two seconds, during which, for example, two pulses of alternating direction, each lasting 0.5 seconds, are produced.

What is claimed is:

1. Crystal-controlled time-keeping apparatus comprising:

a crystal oscillator;

an electric frequency divider circuit coupled to said oscillator and generating bi-directional pulses at a rate dependent on the frequency of said oscillator;

a bi-polar stepping motor controlled by said bidirectional pulses;

said stepping motor including a drive coil and a rotor which rotates through a predetermined angle in response to each of said pulses, said motor further comprising two parallel spaced side plates of a non-conductive non-magnetic material, at least one of which carries a bearing for said rotor, and a plurality of stator plates supported on one of said side plates, said stator plates and said one side plate having cooperating mating projections and recesses which ensure precise positioning of said stator plates on said one side plate, and a gear train driven by said rotor and supported on said side plates.

2. Apparatus as claimed in claim 1 wherein said electronic frequency divider circuit includes a push-pull output supplying drive pulses to the drive coil of said motor, a zener diode being connected in parallel with the power supply to said divider circuit and to said drive coil.

3. Apparatus as claimed in claim 1, wherein an auxiliary yoke spaced from the stator plates is provided on said one side plate, the pole position of said auxiliary yoke being staggered in relation to that of the stator plates.

4. Apparatus as claimed in claim 3, wherein the stator plates are arranged on one side of said one side plate and the auxiliary yoke on the other.

5. Apparatus as claimed in claim 1, wherein one rotor bearing is carried by said one side plate and the other rotor bearing is arranged on the other side plate.

6. Apparatus as claimed in claim 1, wherein one rotor bearing is supported on a bridge piece on said one side plate.

7. Apparatus as claimed in claim 1, wherein one rotor bearing is arranged in a cup-shaped recess in said one side plate partially surrounding the rotor and its pinion.

8. Apparatus as claimed in claim 1, wherein one rotor bearing is arranged on a block formed integrally with said one side plate.

9. Apparatus as claimed in claim 4, wherein said one side plate is formed with projections which fit into holes in the auxiliary yoke.

10. Crystal-controlled time-keeping apparatus comprising two side plates of plastic material; an electrically driven motor having a drive coil, a rotor and a plurality of stator plates attached to one of said side plates; a gear train coupled to a pinion on said rotor and located between said two side plates; a first bearing for said rotor in one wall of a cup-shaped recess formed in said one of said side plates and at least partially enclosing said rotor and said pinion; a second bearing for said rotor in a bridge attached to said one side plate; and an auxiliary yoke spaced from said stator plates and mounted on said one side plate inside said recess.

11. Apparatus as claimed in claim 7, wherein one side of said recess is provided with a slot through which a gear driven by said rotor pinion passes.

12. Apparatus as claimed in claim 1, wherein two flat stator plates are provided and have abutting legs overlapping a core arranged inside the drive coil of the motor.

13. Apparatus as claimed in claim 12, wherein at least one of the legs is located inside the coil.

14. Apparatus as claimed in claim 12, wherein fastener means are provided which link the stator plates and the core with said one side plate in the region in which the core overlaps the legs.

15. Apparatus as claimed in claim 1, wherein said electronic circuit is constituted by a printed circuit including two pins projecting away from the printed circuit boear and extending into the vicinity of the ends of the drive coil for connection thereto.

16. Apparatus as claimed in claim 1, wherein the divider circuit supplies bi-directional pulses to the drive coil, the period of said pulses being two seconds.

17. Apparatus as claimed in claim 1, wherein the resistance of the drive coil is at least 1 K.

18. Apparatus as claimed in claim 1, wherein a resistor is connected between the power supply and the zener diode.

19. Apparatus as claimed in claim 1, wherein the frequency divider circuit supplies drive pulses, the duration of which is greater than the time required by the rotor to step from one position, under the influence of a drive pulse, into the next position.

* * * * *